US007275486B2

(12) United States Patent
Hsieh

(10) Patent No.: US 7,275,486 B2
(45) Date of Patent: Oct. 2, 2007

(54) HAND GRENADE SIMULATING DEVICE

(76) Inventor: Chi-Peng Hsieh, No. 190, Chi-Chi Street, Chi-Chi Chen, Nan-Tou Hsien (TW)

( * ) Notice: Subject to any disclaimer, the term of this patent is extended or adjusted under 35 U.S.C. 154(b) by 180 days.

(21) Appl. No.: 11/046,326

(22) Filed: Jan. 27, 2005

(65) Prior Publication Data

US 2006/0096490 A1 May 11, 2006

(51) Int. Cl.
*F42B 8/26* (2006.01)

(52) U.S. Cl. ..... 102/498; 102/368; 102/482; 102/487; 102/529; 446/473

(58) Field of Classification Search ..... 102/498, 102/482, 487, 502, 513, 529, 368; 446/473, 446/475

See application file for complete search history.

(56) References Cited

U.S. PATENT DOCUMENTS 3,492,945 A * 2/1970 Filippi ..... 102/498
4,932,329 A * 6/1990 Logie ..... 102/498
4,944,521 A * 7/1990 Greeno ..... 473/577
5,996,503 A * 12/1999 Woodall et al. ..... 102/498
6,453,819 B1 * 9/2002 Coates ..... 102/498

* cited by examiner

*Primary Examiner*—James S. Bergin
(74) *Attorney, Agent, or Firm*—Townsend and Townsend and Crew, LLP

(57) ABSTRACT

A hand grenade simulating device includes a first shell filled with a marking filler, a second shell disposed in the first shell for receiving a percussion-triggered charge, a striking member which is remote from the charge in a ready position and which is movable to strike the charge by a biasing force of a biasing member to initiate detonation for exploding the first and second shells and scattering the marking filler, a releasably retaining member which is disposed to hold the striking member in the ready position and which is manually releasable, and a delay member disposed to generate a kinetic frictional force between the striking member and the second shell such that the striking member is dragged by the frictional force against the biasing force of the biasing member when the releasably retained member is released.

11 Claims, 6 Drawing Sheets

HAND GRENADE SIMULATING DEVICE

BACKGROUND OF THE INVENTION

1. Field of the Invention

This invention relates to a hand grenade simulating device, more particularly to a hand grenade simulating device which simulates a hand grenade to be used in military training or recreational war games.

2. Description of the Related Art

Referring to FIG. 1, a conventional simulated hand grenade used in military training or recreational war games, such as that disclosed in U.S. Pat. No. 4,932,329, includes a frangible outer shell 6, a small charge 2 within the shell 6, a fuse 3 for delaying detonation of the charge 2, an ignition member 1 for activating the fuse 3, and a dye powder 4 is filled within the shell 6. The fuse 3 is a lacquered igniter wire which burns to provide a delayed detonation of two to ten seconds after ignition. The ignition member 1 has a spring-loaded hammer 9 disposed to impact a primer cap 7 when released so as to explode the cap 7, thereby igniting an end of the igniter wire 3. The spring-loaded hammer 9 is held by a lever 8 which is pivotally mounted on the top of the simulated hand grenade and which is secured against accidental release by a safety pin 5. This conventional simulated hand grenade can simulate a grenade realistically and can produce marking of a target area. However, the ignition member 1 has a complicated structure and thus is difficult and expensive to fabricate.

SUMMARY OF THE INVENTION

The object of the present invention is to provide a hand grenade simulating device which has a simple construction and which is easy to fabricate at a relatively low cost.

According to this invention, the hand grenade simulating device includes a first shell defining a first accommodation space therein and a first access opening for accessing the first accommodation space. A second shell is received in the first accommodation space by extending through the first access opening, and includes a bottom wall and a surrounding wall extending from a periphery of the bottom wall in a longitudinal direction to define a second accommodation space therein and to terminate at a peripheral edge which extends outwardly of the first access opening, and which defines a second access opening for accessing the second accommodation space. The bottom and surrounding walls are made to burst when a pressure in the second accommodation space increases to a predetermined value. A marking filler is disposed within the first accommodation space such that the marking filler is dispersed in response to bursting of the bottom and surrounding walls of the second shell. A percussion-triggered charge is disposed in the second accommodation space proximate to the bottom wall, and is spaced apart from the peripheral edge. A striking member is disposed in the second accommodation space, and has an upper retained end and a lower striking end opposite to each other in the longitudinal direction, and a shank interposed therebetween. The striking member is movable relative to the bottom wall in the longitudinal direction between a ready position where the lower striking end is remote from the percussion-triggered charge, and a striking position where the lower striking end strikes the percussion-triggered charge to initiate detonation, thereby increasing the pressure in the second accommodation space to the predetermined value to explode the first and second shells for scattering the marking filler. A biasing member is disposed to bias the striking member toward the striking position. A releasably retaining member is disposed to hold the striking member in the ready position by virtue of engagement with the retained end against the biasing force of the biasing member, and is manually releasable. A delay member is disposed to generate a kinetic frictional force between the shank and the surrounding wall when the striking member is moved from the ready position to the striking position such that the striking member is dragged by the kinetic frictional force against the biasing force of the biasing member when the releasably retaining member is released.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
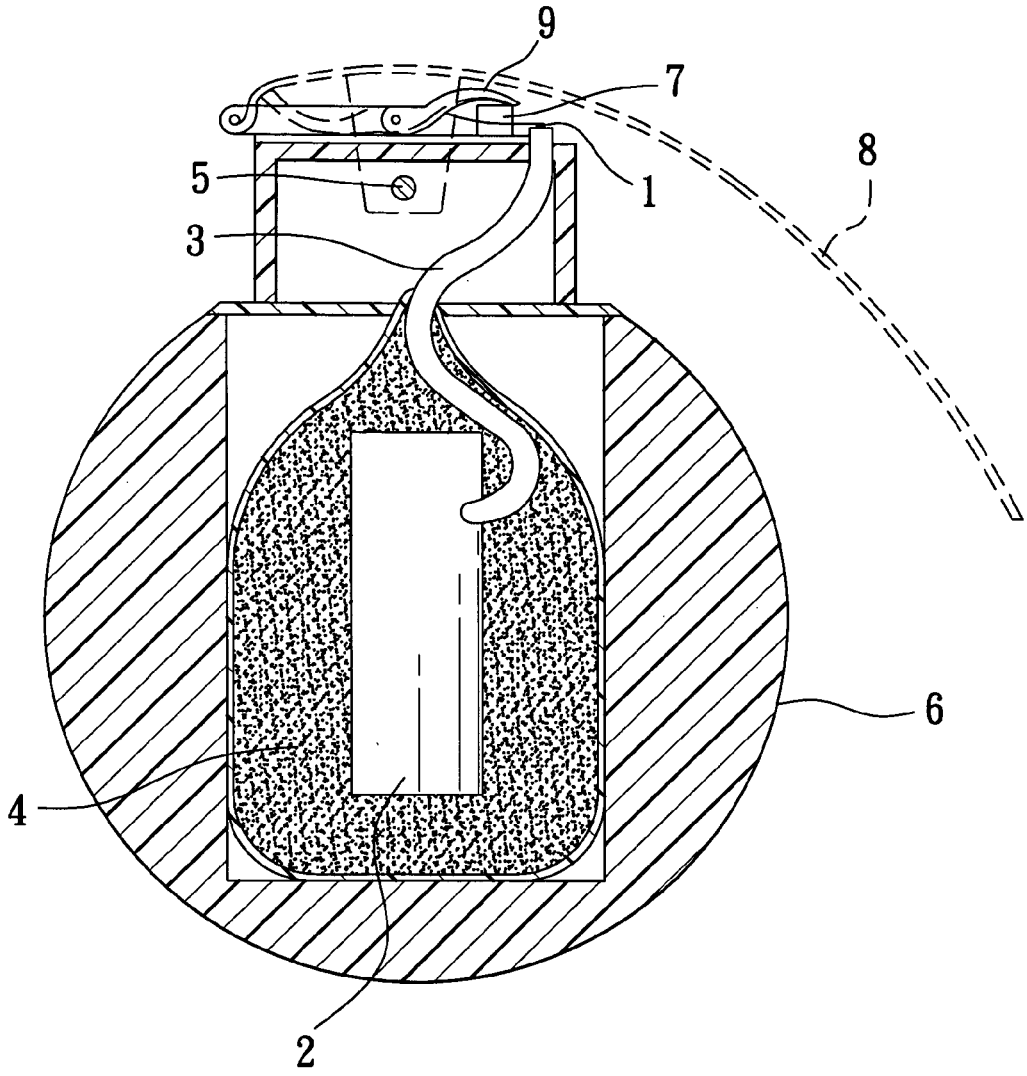
FIG. 1 PRIOR ART
FIG. 1 is a sectional view of a conventional simulated hand grenade.
Figure 2:
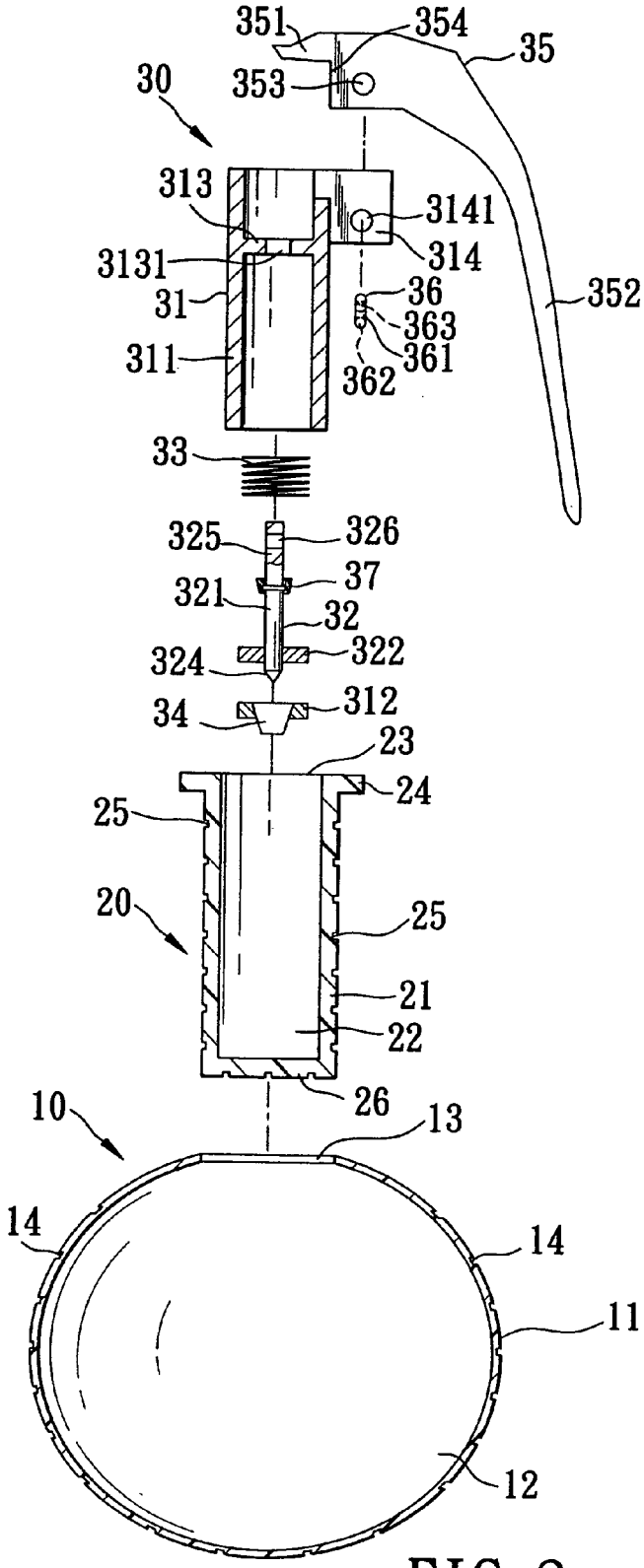
FIG. 2 is an exploded sectional view of the preferred embodiment of a hand grenade simulating device according to this invention.
Figure 3:
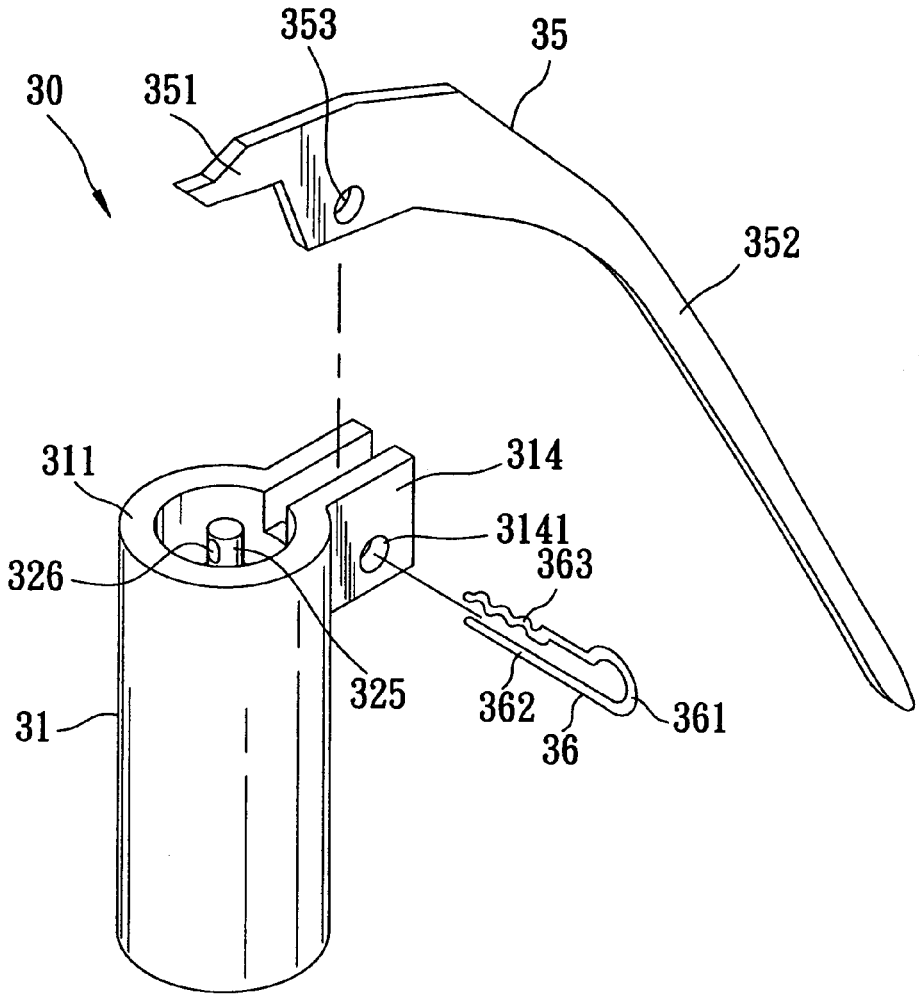
FIG. 3 is an exploded perspective view of a portion of the preferred embodiment.
Figure 4:
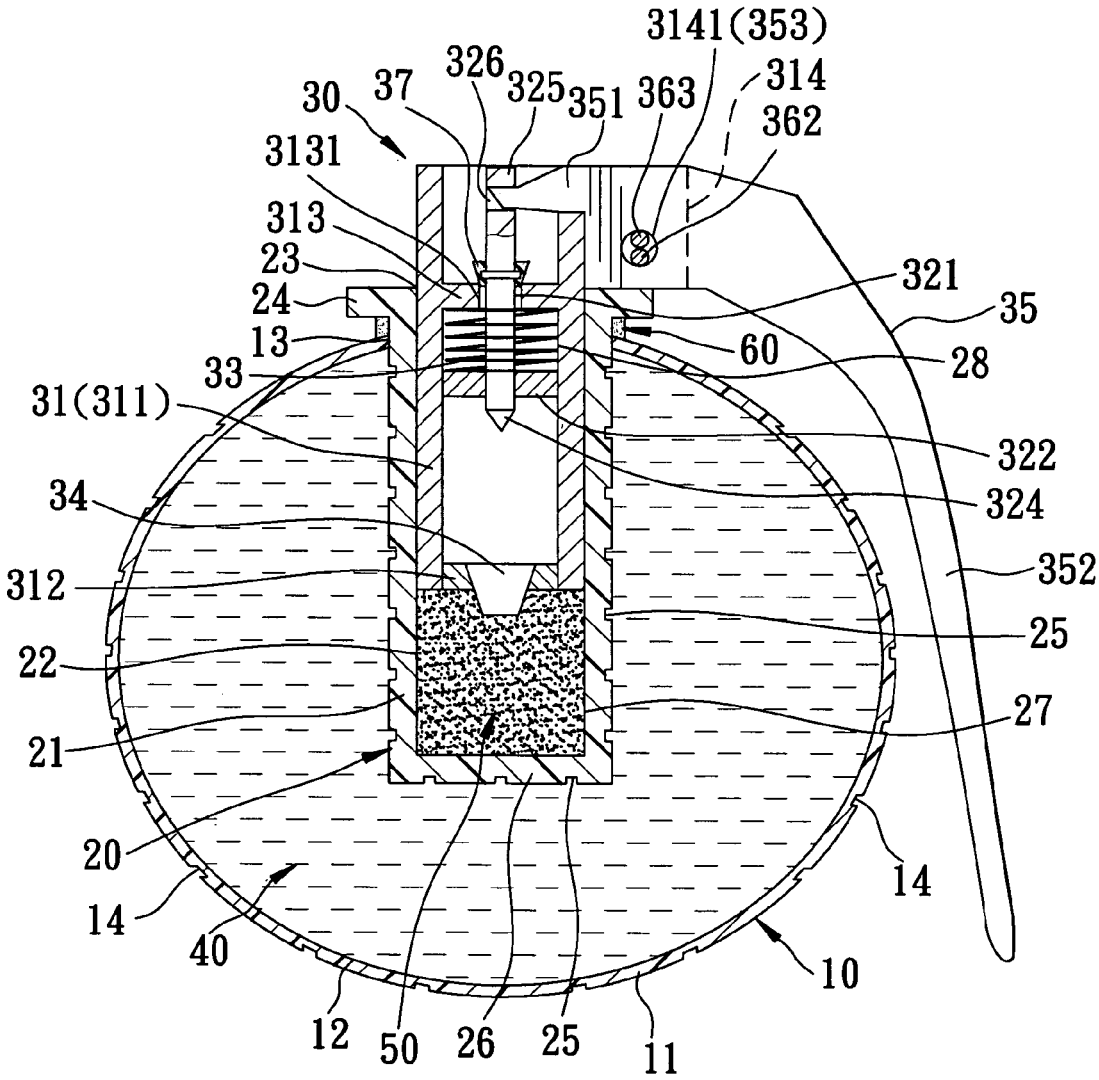
FIG. 4 is a sectional view of the preferred embodiment in a ready state.

Referring to FIGS. 2 to 4, the preferred embodiment of a hand grenade simulating device according to the present invention is shown to comprise a first shell 10, a second shell 20, an ignition unit 30, a marking filler 40, a colored powder 50, and a seal member 60.

The first shell 10 is made from a soft plastic material, such as PE, and has a spherical wall 11 defining a first accommodation space 12 therein and a first access opening 13 for accessing the first accommodation space 12. A plurality of weakening indents 14 are formed in the spherical wall 11 so as to render the first shell 10 prone to rupture.

The second shell 20 is received in the first accommodation space 12 by extending through the first access opening 13, and includes a bottom wall 26 with a periphery, and a surrounding wall 21 integrally formed from the periphery of the bottom wall 26 and extending from the periphery of the bottom wall 26 in a longitudinal direction to define a second accommodation space 22 therein and to terminate at a peripheral edge 24 which extends outwardly of the first access opening 13, and which defines a second access opening 23 for accessing the second accommodation space 22. The bottom and surrounding walls 26, 21 are made from a soft plastic material, such as PE a material, such that when a pressure in the second accommodation space 22 increases to a predetermined value, the bottom and surrounding walls 26, 21 burst. A plurality of weakening indents 25 are formed in the bottom and surrounding walls 26, 21 so as to render the second shell 20 prone to rupture. Moreover, the surrounding wall 21 has a diameter which is substantially the same as that of the first access opening 13 so as to substantially close the first access opening 13.

The marking filler 40, such as a colored dye fluid, is disposed within the first accommodation space 12 such that the marking filler 40 is dispersed in response to bursting of the first shell 10. The seal member 60 is disposed between the peripheral edge 24 and the spherical wall 11 at the first access opening 13 for providing a fluid-tight engagement therebetween. In this embodiment, the seal member 60 is formed by an injecting forming process after the second shell 20 is disposed in the first shell 10.

The second shell 20 further includes a tubular member 31 which is disposed in the second accommodation space 22. The tubular member 31 includes a tubular wall 311 which is secured to the surrounding wall 21, a seat wall 313 which extends radially and inwardly from the tubular wall 311 and which defines a through hole 3131 extending therethrough in the longitudinal direction, a lug 314 which extends from the tubular wall 311, which projects outwardly of the peripheral edge 24, and which has a mounting hole 3141 extending in a transverse direction relative to the longitudinal direction, and a partition wall 312 which extends radially and inwardly from the tubular wall 311 and which is spaced apart from the bottom wall 26 in the longitudinal direction so as to define a powder receiving space 27 therebetween for receiving the colored powder 50. In this embodiment, the colored powder 50 is made from a material capable of giving off a colored smoke when the first and second shells 10, 20 burst so as to simulate detonation of a hand grenade more realistically.

Figure 6:
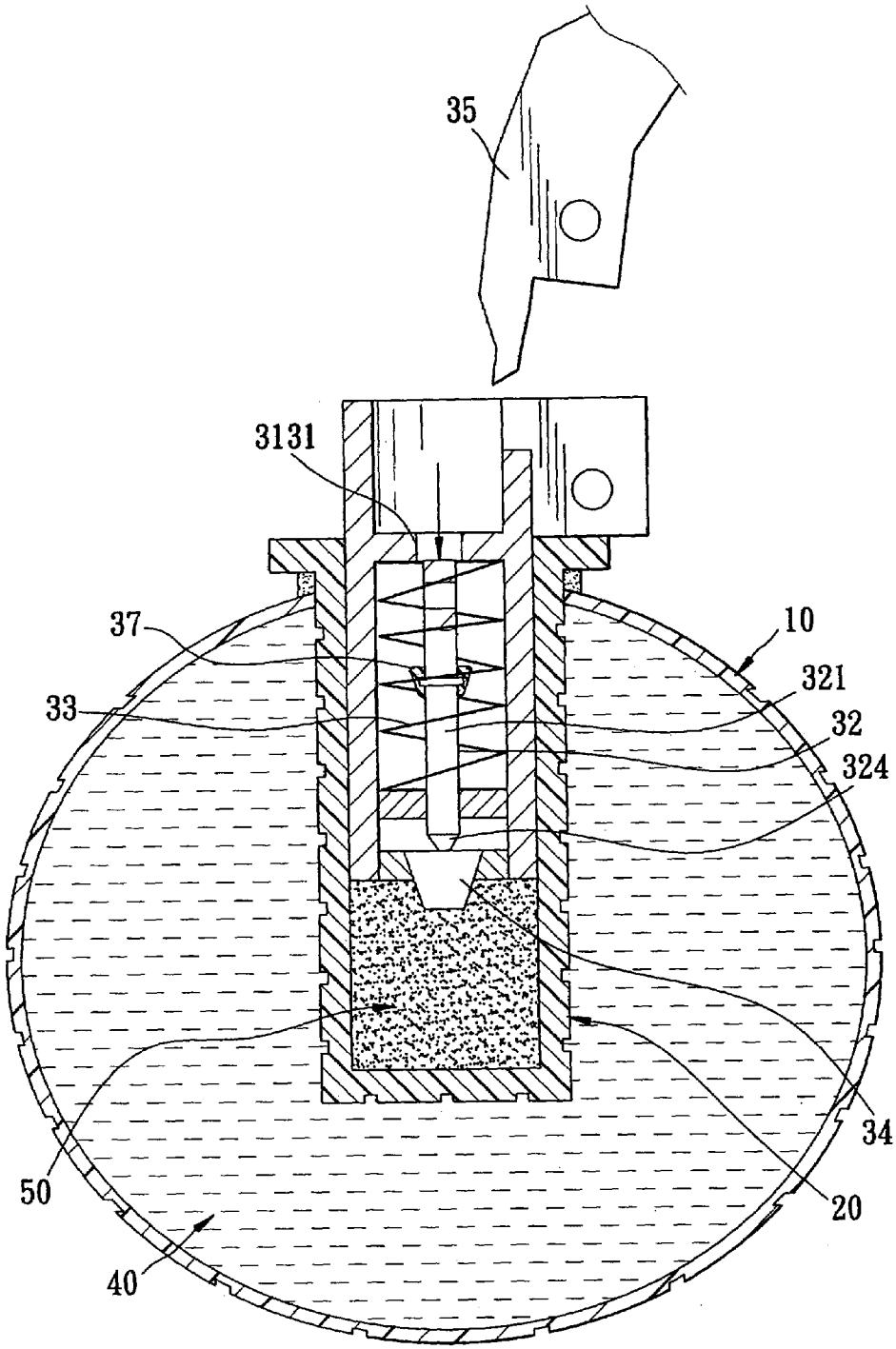
FIG. 6 is a sectional view of the preferred embodiment in a striking state.

The ignition unit 30 includes a percussion-triggered charge 34 which is disposed to extend through the partition wall 312, and an elongated striking member 32 which is disposed within the tubular wall 311 and which has an upper retained end 325 and a pointed lower striking end 324 opposite to each other in the longitudinal direction, and a shank 321 that is interposed between the upper retained end 325 and the lower striking end 324 and that extends through the through hole 3131 in the seat wall 313. The upper retained end 325 has a retained hole 326 formed therein. A disk 322 is disposed on and extends radially and outwardly from the shank 321 and is spaced apart from the seat wall 313 so as to define a spring receiving space 28 therebetween. A biasing member 33, such as a biasing spring, is disposed in the spring receiving space 28 and biases the disk 322 towards the bottom wall 26. Thus, the striking member 32 is movable relative to the bottom wall 26 in the longitudinal direction between a ready position where the lower striking end 324 is remote from the charge 34 (see FIG. 4), and a striking position where the lower striking end 324 strikes the charge 34 to initiate detonation (see FIG. 6), which results in an increase in the pressure in the second accommodation space 22 to the predetermined value to thereby explode the first and second shells 10, 20 and scatter the marking filler 40.

Figure 5:
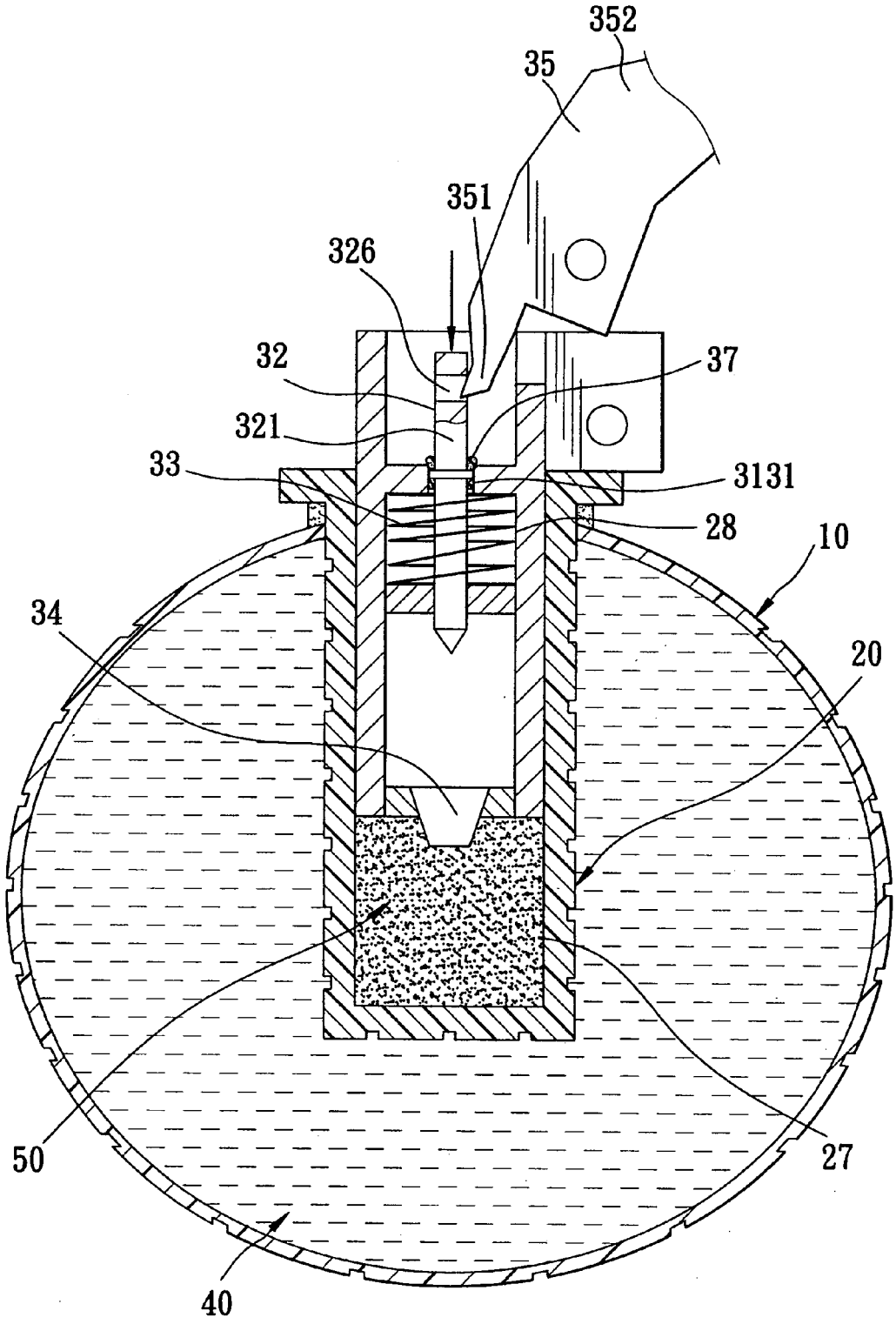
FIG. 5 is a sectional view of the preferred embodiment in a released state.

A releasably retaining member includes a lever 35 and a safety pin 36. The lever 35 has a latch end 351 and a grip end 352 which are opposite to each other relative to a fulcrum 354. An insert hole 353 is formed offset from the fulcrum 354 and is aligned with the mounting hole 3141 in the lug 314. The safety pin 36 includes a bent portion 361 and two end portions 362, 363 which respectively extend from the bent portion 361 and which are detachably inserted into the mounting hole 3141 and the insert hole 353 so as to hold the lever 35 in a retaining position, as shown in FIG. 4, where the grip end 352 is close to the first shell 10, whereas the latch end 351 engages the retained hole 326 in the upper retained end 325, and holds the upper retained end 325 in the ready position against the biasing force of the biasing member 33. When the safety pin 36 is pulled out of the mounting hole 3141 and the insert hole 353 by the user, as shown in FIG. 5, the grip end 352 is movable to a releasing position, where the grip end 352 is remote from the first shell 10, whereas the latch end 351 disengages the retained hole 326 to permit the striking member 32 to move to the striking position.

A delay member 37 is retained on and surrounds the shank 321 of the striking member 32, and is made from a deformable material, such as rubber, so as to be forced to yield radially. Preferably, the delay member 37 is tapered towards the lower striking end 324. Thus, when the striking member 32 is moved from the ready position to the striking position after the safety pin 36 is removed to permit movement of the lever 35 from the retaining position to the releasing position, as shown in FIG. 5, the delay member 37 is moved to pass through the through hole 3131 so as to generate a kinetic frictional force between the delay member 37 and the seat wall 313, the kinetic frictional force increasing incrementally such that the striking member 32 is dragged by the kinetic frictional force against the biasing force of the biasing member 33. Once the delay member 37 has passed through the through hole 3131, the lower striking end 324 is moved immediately by the biasing member 33 to strike the charge 34 to initiate detonation, thereby exploding the first and second shells 10, 20 and scattering the marking filler 40 and the colored powder 50 that gives off a colored smoke.

During assembly, the striking member 32, the biasing member 33 and the charge 34 are mounted in the tubular member 31 to form the ignition unit 30. The ignition unit 30 is then mounted in the second shell 20 in which the colored powder 50 is received. The second shell 20 is disposed in the first shell 10 in which the marking filler 40 is received, and the seal member 60 is disposed in position. The striking member 32 is held in the ready position in such a manner that the latch end 351 engages the retained hole 326, and the lever end 352 is turned to the retaining position against the biasing force of the biasing member 33. The safety pin 36 is inserted into the holes 3141, 353 to hold the lever 35 in the retaining position. Since the delay member 37 is made from a deformable material and is disposed to surround the shank 321, the hand grenade simulating device of this invention has a simple construction, and does not require a fuse, a primer cap, and a spring-loaded hammer for igniting the explosive charge as in the aforementioned prior art. Thus, the hand grenade simulating device of this invention can be fabricated with relative ease at a relatively low cost.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A hand grenade simulating device comprising:

a first shell defining a first accommodation space therein and a first access opening for accessing said first accommodation space;

a second shell received in said first accommodation space by extending through said first access opening, and including a bottom wall with a periphery, and a surrounding wall extending from said periphery of said bottom wall in a longitudinal direction to define a second accommodation space therein and to terminate at a peripheral edge which extends outwardly of said first access opening, and which defines a second access opening for accessing said second accommodation space, said bottom and surrounding walls being made from a material such that when a pressure in said second accommodation space increases to a predetermined value, said bottom and surrounding walls burst;

a marking filler disposed within said first accommodation space such that said marking filler is dispersed in response to bursting of said bottom and surrounding walls of said second shell;

a percussion-triggered charge disposed in said second accommodation space proximate to said bottom wall, and spaced apart from said peripheral edge;

a striking member disposed in said second accommodation space, and having an upper retained end and a lower striking end opposite to each other in the longitudinal direction, and a shank interposed therebetween, said striking member being movable relative to said bottom wall in the longitudinal direction between a ready position where said lower striking end is remote from said percussion-triggered charge, and a striking position where said lower striking end strikes said percussion triggered charge to initiate detonation, thereby increasing the pressure in said second accommodation space to the predetermined value to explode said first and second shells for scattering said marking filler;

a biasing member disposed to bias said striking member toward the striking position;

a releasably retaining member which is disposed to hold said striking member in the ready position by virtue of engagement with said upper retained end against biasing force of said biasing member, and which is manually releasable; and a delay member disposed to generate a kinetic frictional force between said shank and said surrounding wall when said striking member is moved from the ready position to the striking position such that said striking member is dragged by the kinetic frictional force against the biasing force of said biasing member when said releasably retaining member is released.

2. The hand grenade simulating device of claim 1, wherein said delay member is retained on and surrounds said shank of said striking member, and is made from such a deformable material as to be forced to yield radially, thereby generating the kinetic frictional force when said striking member is moved from the ready position to the striking position.

3. The hand grenade simulating device of claim 2, wherein said second shell includes a tubular member which is disposed in said second accommodation space and which includes a tubular wall that is secured to said surrounding wall, and a seat wall that extends radially and inwardly from said tubular wall and that defines a through hole extending therethrough in the longitudinal direction for passage of said shank of said striking member therethrough, said delay member being configured such that the kinetic frictional force increases incrementally when said striking member is moved from the ready position to the striking position.

4. The hand grenade simulating device of claim 3, wherein said delay member is tapered towards said lower striking end.

5. The hand grenade simulating device of claim 3, wherein said releasably retaining member includes a lever having a latch end and a grip end which are opposite to each other relative to a fulcrum, said grip end being movable between a retaining position where said grip end is close to said first shell, whereas said latch end engages and holds said upper retained end in the ready position against the biasing force of said biasing member, and a releasing position where said grip end is remote from said first shell, whereas said latch end disengages said upper retained end to permit said striking member to move to the striking position; and a safety pin which is disposed to prevent movement of said grip end from the retaining position to the releasing position.

6. The hand grenade simulating device of claim 5, wherein said tubular member further includes a lug which extends from said tubular wall, which projects outwardly of said peripheral edge, and which has a mounting hole extending in a transverse direction relative to the longitudinal direction, said lever having an insert hole which is offset from said fulcrum and which is aligned with said mounting hole such that said safety pin is detachably inserted into said mounting hole and said insert hole so as to hold said lever in the retaining position.

7. The hand grenade simulating device of claim 3, wherein said striking member has a disk which is disposed on and which extends radially and outwardly from said shank and which is spaced apart from said seat wall so as to define a spring receiving space therebetween, said biasing member being a biasing spring which is disposed in said spring receiving space and which biases said disk towards said bottom wall.

8. The hand grenade simulating device of claim 2, wherein said tubular member includes a partition wall which extends radially and inwardly from said tubular wall and which is spaced apart from said bottom wall in the longitudinal direction so as to define a powder receiving space therebetween, said percussion-triggered charge being disposed to extend through said partition wall, said hand grenade simulating device further comprising a colored powder which is received in said powder receiving space and which is made from a material capable of giving off a colored smoke when said bottom and surrounding walls burst.

9. The hand grenade simulating device of claim 1, further comprising a seal member disposed between said peripheral edge of said second shell and said first shell at said first access opening for providing a fluid-tight engagement therebetween.

10. The hand grenade simulating device of claim 1, wherein each of said first and second shells has a plurality of weakening indents which render said first and second shells prone to rupture.

11. The hand grenade simulating device of claim 1, wherein said lower striking end of said striking member is pointed.

* * * * *